US005113878A

United States Patent [19]

Polese

[11] Patent Number: 5,113,878

[45] Date of Patent: May 19, 1992

[54] CIGARETTE-HOLDER INCLUDING A FILTER, SUITABLE TO WEAN SMOKERS FROM THE HABIT OF SMOKING

[76] Inventor: Pasquale Polese, Via Gramsci, 4, Porto Torres (Sassari), Italy, 07046

[21] Appl. No.: 544,606

[22] Filed: Jun. 27, 1990

[30] Foreign Application Priority Data

Jul. 13, 1989 [IT] Italy ..... 48186 A/89

[51] Int. Cl.[5] ..... A24D 3/04

[52] U.S. Cl. ..... 131/198.2; 131/211; 131/336

[58] Field of Search ..... 131/211, 198, 198.2, 131/336, 194

[56] References Cited

U.S. PATENT DOCUMENTS

| | | | |
|---|---|---|---|
| 2,998,819 | 9/1961 | Snowden | 131/194 |
| 3,581,748 | 6/1971 | Cameron | 131/336 |
| 3,646,941 | 3/1972 | Doppelt | 131/211 |
| 4,649,945 | 3/1987 | Norman et al. | 131/198.2 |

*Primary Examiner*—V. Millin

*Attorney, Agent, or Firm*—Andrus, Sceales, Starke et al.

[57] ABSTRACT

A cigarette-holder is disclosed which is provided with a filter member as well as with a device for regulating draught, which device allows the amount of nicotine inhaled to be progressively reduced. The device comprises a small metallic pipe that holds, on one end, the cigarette. The pipe is inserted with the opposite end into the cigarette-holder containing a filter member. The filter member is made up of a small hollow cylinder of diameter less than the pipe diameter, and it obstructs the smoke flow into the cigarette-holder by leaving just a small through-hole and delimits an annular space wherein smoke becomes further cooled before being inhaled. The filter is also made up of a bowl-like plugging member that reduces the outlet cross section of the holder. The bottom of the bowl-like plugging member faces the end of the pipe containing the cigarette. The plugging member has cuts in its side wall and a peg-like terminal portion in its bottom. The regulation of draught occurs owing to a shiftable clamp which obstructs, totally or partially according to its position, a set of holes which are provided in the walls of said pipe, thereby varying the amount of air that is mixed with smoke before reaching the filter member.

7 Claims, 1 Drawing Sheet

CIGARETTE-HOLDER INCLUDING A FILTER, SUITABLE TO WEAN SMOKERS FROM THE HABIT OF SMOKING

This invention relates to a cigarette holder comprising a double filter and a device for regulating draught, which device allows the amount of nicotine inhaled to be gradually decreased so that the smoker becomes slowly weaned from the habit of smoking.

Numerous attempts have been made to realize cigarette-holders capable of allowing the inhalation of tars and nicotine to be decreased, so as to cause the smoker to become progressively weaned from smoking, without particular sacrifices on the part of the smoker himself.

Such devices are all based on the fact that tars and nicotine have boiling points higher than those of the other compounds which are present in the cigarette smoke, which compounds give the smoke its flavour and aroma and accordingly tars and nicotine can be removed from the smoke by cooling it without smoker's perception of the absence of them.

Some cigarette-holders commercially available are based on the Venturi effect. They provide the speeding up of the smoke within a portion of the cigarette-holder, said portion being in the shape of a Venturi throat, up to values beyond 300 km/hr. This is followed by the striking of the smoke against a barrier or a diaphragm at a point where the smoke, being now cooled to a lower temperature, is below its condensation temperature. However, due to their own nature, such holders do not allow any kind of regulation: accordingly, the smoker is not in a position to programme a gradual reduction of the nicotine inhaled.

On the contrary, in other cigarette-holders commercially available at present the draught is caused to vary by gradually mixing smoke with fresh air through an adjustable opening or "window" in the stem, so as to reduce the temperature of the smoke inhaled and hence the amount of nicotine inhaled. However, such cigarette-holders completely lack filters or any other members capable of intercepting nicotine mechanically so that they only are operative when the outside air is introduced in noticeable amounts.

The object of the present invention consists in providing a filter-bearing cigarette-holder which, taking advantage of the various techniques already known in the prior art, allows the problem of weaning smokers from the habit of smoking to be completely solved in a simple and economic way, by giving the smoker the possibility of programming with certainty a safe and gradual reduction of nicotine inhaled.

Indeed, according to the present finding, a device is provided which comprises:

a metallic pipe in which a set of staggered holes is obtained, which holes become partially or totally plugged by a clamp which is externally wound around the same pipe;

a first filter made up of a small metallic cylinder of reduced diameter with respect to the diameter of said pipe, said cylinder being drilled on one side and open at the opposite part;

the cigarette-holder, comprising a simple tubular member made up of a plastic material which closes said pipe on the side opposite to the cigarette and is closed in turn by said first filter on the part which is inside the pipe itself, which filter is partially inserted with its open end, and a second filter or plugging member in the shape of a bowl provided with longitudinal cuts and ending with a peg, said filter reducing the outlet cross section when inserted into the cigarette-holder.

Smoke coming from said pipe is thus forced to pass through the hole or holes which are obtained in the filter for reaching the cigarette-holder, said smoke being stopped for some time within an annular space wherein smoke already mixed with air coming from the pipe holes can become further cooled owing to its contact with the metallic wall of the first filter before passing through the plugging member arranged at the outlet.

Further features and advantages of the present invention will be evident from the detailed disclosure that follows, which disclosure is based on the enclosed drawings which illustrate just for exemplification and not for limitative purposes a preferred kind of embodiment of the present finding. In the drawings.

Figure 1:
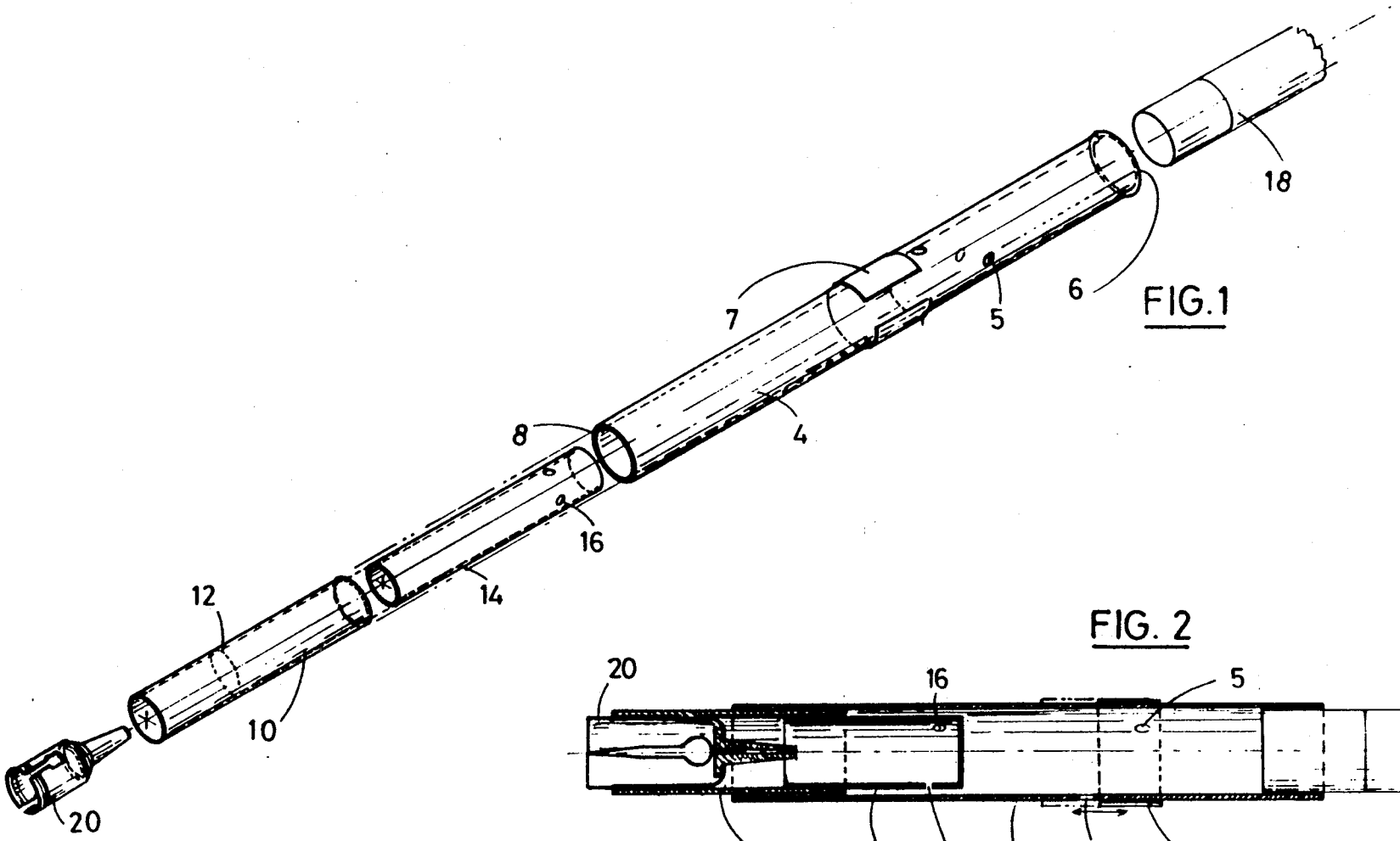
FIG. 1 is an exploded perspective view of the present invention.
Figure 2:
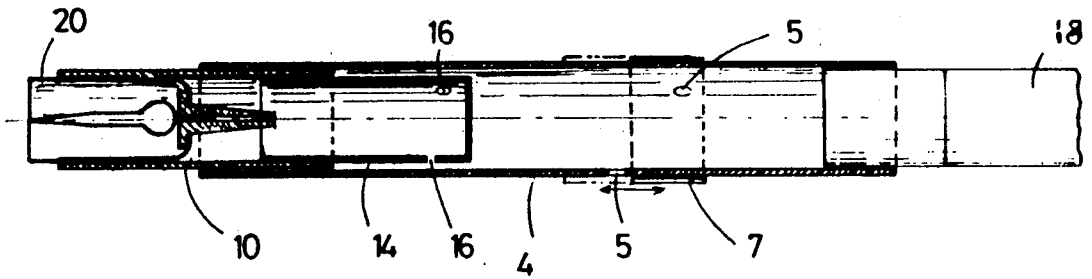
FIG. 2 shows a cross-sectional view of the cigarette-holder that is adapted to hold a cigarette.

With reference now to the figures mentioned above, the present invention comprises a metallic pipe 4 whose edges at the ends 6 and 8 are preferably flared in order to ensure an easy insertion of the cigarette 18 and of the cigarette-holder 10 respectively. A plurality of through-holes 5 are obtained in said metallic pipe 4, the outside air passing through them into the pipe so as to become mixed with the cigarette's smoke. The amount of incoming air can be regulated by means of a metallic clamp 7 that can be shifted along the outside surface of the pipe so as to cover one or more holes 5.

The cigarette-holder 10 is made up of a sleeve of diameter less than that of the pipe, said sleeve being tapered at the end which is intended for contacting the smoker's lips and being provided with an inner annular thickening 12 against which the open end of a small metallic cylinder 14 abuts, said small cylinder being of a smaller diameter and performing the function of a filter. To realize such function, said small metallic cylinder bears on the portion protruding into the pipe 4 at least a small through-hole 16 which causes the inside part of the pipe to communicate with the cigarette-holder 10. The outlet cross section of said cigarette-holder 10 is closed by a second filter or plugging member 20 which is in the shape of a small bowl bearing two longitudinal cuts, and a terminal portion in the shape of a peg which is facing the inside.

The operation is as follows: when the smoker inhales the smoke, said smoke coming from the cigarette reaches the intermediate zone of the pipe wherein it becomes mixed with air possibly introduced through one or more holes 5. Smoke already partially cooled becomes further cooled while waiting for passing into the hole 16, by losing heat on contact with the metallic walls of the pipe 4 and of the filter member 14. As smoke comes out of the hole 16, it becomes expanded towards the cigarette-holder 10 so as to cool to a temperature which is lower than the condensation temperature of nicotine which is thus collected at the back of the filter itself as well as at the plugging member.

Accordingly, smoke reaching the smoker's mouth contains just trace amounts of nicotine, and the smoker can shortly reduce his/her demand of cigarettes as he/- she becomes gradually weaned from the habit of smoking and detoxicated without being aware of that.

According to a variant embodiment of the present finding, a small piston or capsule, preferably made up of polystyrene, is inserted into the cigarette-holder 10 as a substitute for the second filter 20 or in addition to the same within said small metallic cylinder 14, said small piston or capsule being capable of moving freely along the inhalation conduit, so that the amount of smoke inhaled and then the amount of outlet nicotine is further reduced.

The present invention has been disclosed and illustrated on the basis of a preferred embodiment of the same: it is to be understood that numerous modifications and changes can be introduced by those who are skilled in the art without departing from the scope of the present invention when such variant embodiments are intended for obtaining the same object as the present invention. Accordingly, various lengths could be provided for instance in order to accommodate various requirements on the smoker's part.

I claim:

1. A device for progressively reducing, in a programmable way, the inhalation by a smoker of nicotine produced by a cigarette, said device comprising:

a cylindrical pipe having a set of staggered through-holes on the surface thereof, said pipe having first and second ends, said first end being suitable for receiving the unlit end of a cigarette and the smoke therefrom;

an annular member elastically embracing said pipe and a positionable on the surface thereof so as to partially or totally cover said through-holes for varying the amount of air admitted to the pipe and mixed with cigarette smoke inside said pipe;

a holder inserted into said pipe in said second end of said pipe, said holder having an inner passage partially plugged by a bowl-like member, the bottom of which faces said first end of said pipe, said bowl-like member being provided with longitudinal cuts in a wall thereof and a peg-like terminal portion in the bottom thereof; and a filter member in the shape of a small cylindrical capsule, said capsule-like filter member being internally hollow and open at one end, said capsule-like filter member being arranged in said holder and inside said pipe so as to obstruct the inner passage of said holder, said capsule-like filter member having at least one through-hole in said capsule, the diameter of said capsule being less than the diameter of said pipe for forming an annular space within said pipe in which the cigarette smoke becomes cooled prior to passage through said hole.

2. A device according to claim 1, characterized in that said pipe and said filter member both are made up of a metallic material in order to increase the heat exchange with smoke.

3. A device according to claim 1, characterized in that said pipe is provided with a knurling in order to make the smoker's grasp easier.

4. A device according to claim 1, characterized in that the holes on said pipe are three in number and one of them is staggered with respect to the two others.

5. A device according to claim 1, characterized in that the capsule making up the filter member has a through-hole, which is provided in a side wall.

6. A device according to claim 5, characterized in that the filter member bears three holes which are arranged along a side wall.

7. A device according to claim 1, characterized in that it includes a small piston which is made up of polystyrene and is so assembled as to be slidable within a cylindrical capsule that makes up the filter member.

* * * * *